US008212636B2

(12) United States Patent
Fujimoto et al.

(10) Patent No.: US 8,212,636 B2
(45) Date of Patent: Jul. 3, 2012

(54) ELECTROMAGNETIC RELAY

(75) Inventors: Koji Fujimoto, Yamaga (JP); Shinichi Furusho, Kumamoto (JP); Akifumi Fujino, Yamaga (JP)

(73) Assignee: Omron Corporation, Kyoto (JP)

( * ) Notice: Subject to any disclaimer, the term of this patent is extended or adjusted under 35 U.S.C. 154(b) by 226 days.

(21) Appl. No.: 12/714,311

(22) Filed: Feb. 26, 2010

(65) Prior Publication Data

US 2010/0225428 A1 Sep. 9, 2010

(30) Foreign Application Priority Data

Mar. 6, 2009 (JP) ..... 2009-053950

(51) Int. Cl.
*H01H 51/22* (2006.01)

(52) U.S. Cl. ..... 335/78

(58) Field of Classification Search ..... 335/78
See application file for complete search history.

(56) References Cited

U.S. PATENT DOCUMENTS

| | | | | |
|---|---|---|---|---|
| 4,695,813 | A * | 9/1987 | Nobutoki et al. | 335/78 |
| 4,914,411 | A * | 4/1990 | Hikita et al. | 335/128 |
| 5,191,306 | A * | 3/1993 | Kaji et al. | 335/78 |
| 5,304,970 | A * | 4/1994 | Okamoto et al. | 335/78 |
| 5,396,204 | A * | 3/1995 | Matsuoka et al. | 335/78 |
| 5,548,259 | A * | 8/1996 | Ide et al. | 335/78 |
| 5,757,255 | A * | 5/1998 | Noda et al. | 335/78 |
| 6,633,214 | B2 * | 10/2003 | Mochizuki | 335/128 |
| 6,771,153 | B2 | 8/2004 | Mochizuki | |
| 2002/0057147 | A1 * | 5/2002 | Shinoura et al. | 335/78 |

* cited by examiner

*Primary Examiner* — Elvin G Enad
*Assistant Examiner* — Alexander Talpalatskiy
(74) *Attorney, Agent, or Firm* — Rabin & Berdo, P.C.

(57) ABSTRACT

An electromagnetic relay having a high positioning accuracy of a movable iron piece and little variation in operating characteristics. A pair of upper and lower rotating shaft convex portions are provided at one end of a movable iron piece along the same shaft center. The pair of upper and lower rotating shaft convex portions are rotatably supported by a base and a spool of an electromagnetic block mounted on the base respectively. A movable contact piece is driven by the movable iron piece rotated by magnetization or demagnetization of the electromagnetic block to open or close a contact. One end of the spool has a shaft hole in which the upper rotating shaft convex portion of the movable iron piece is inserted.

3 Claims, 17 Drawing Sheets

ELECTROMAGNETIC RELAY

BACKGROUND

The present invention is related to an electromagnetic relay, more specifically to an electromagnetic relay in which a contact is opened or closed by an armature rotated by magnetization or demagnetization of an electromagnetic block.

Conventionally, there is known an electromagnetic relay in which a movable contact piece is pressed or released by an armature rotated by magnetization or demagnetization of an electromagnetic block, thereby a movable contact comes into contact with or separates from a fixed contact.

In the above-mentioned electromagnetic relay, a shaft hole for supporting an upper-end shaft of the armature is formed by a cutout of a spool flange and a partition wall of a base. Thus, the accuracy of dimensions and positioning is significantly affected by accumulation errors and assembly errors of these two parts, and thereby operating characteristics may vary unfavorably.

BRIEF SUMMARY

An electromagnetic relay according to an embodiment of the present invention is configured such that a pair of convex portions formed on upper and lower ends of a rotating shaft along the same center of the rotating shaft provided at one end of an armature is rotatably supported by a base and a spool of an electromagnetic block mounted on the base, and a movable contact piece is driven by the armature rotated by magnetization or demagnetization of the electromagnetic block, thereby opening or closing a contact, wherein a shaft hole into which the upper convex portion of the rotating shaft is inserted is formed at one end of the spool.

According to another embodiment of the invention, a projection for positioning an iron core with respect to the spool may be provided on one end of the spool on which the iron core is mounted, the projection being arranged to be adjacent to the shaft hole for rotatably supporting the armature.

DETAILED DESCRIPTION

Embodiments according to the invention are described with reference to FIGS. 1 to 12. An electromagnetic relay according to a first embodiment includes a base 10, an electromagnetic block 30, an armature 60 and a case 70 as shown in FIGS. 1 to 10.

Figure 3A:
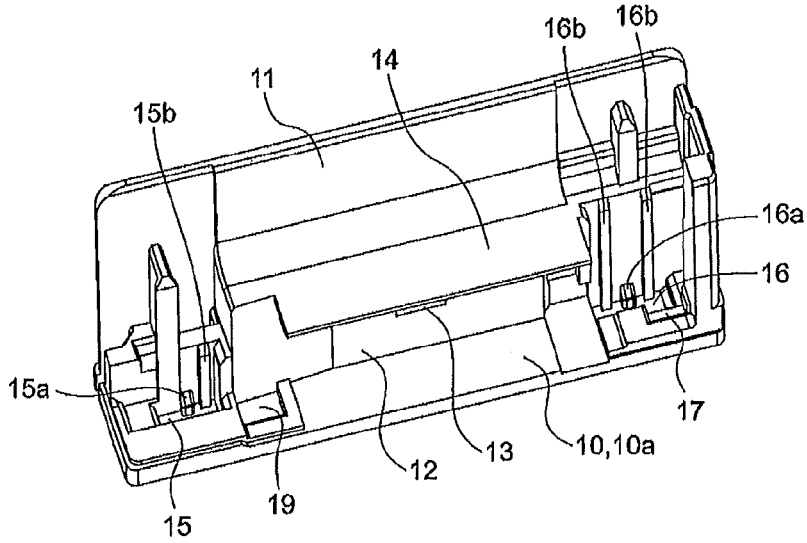
FIG. 3A is a perspective view of a base shown in FIG. 2
Figure 10A:
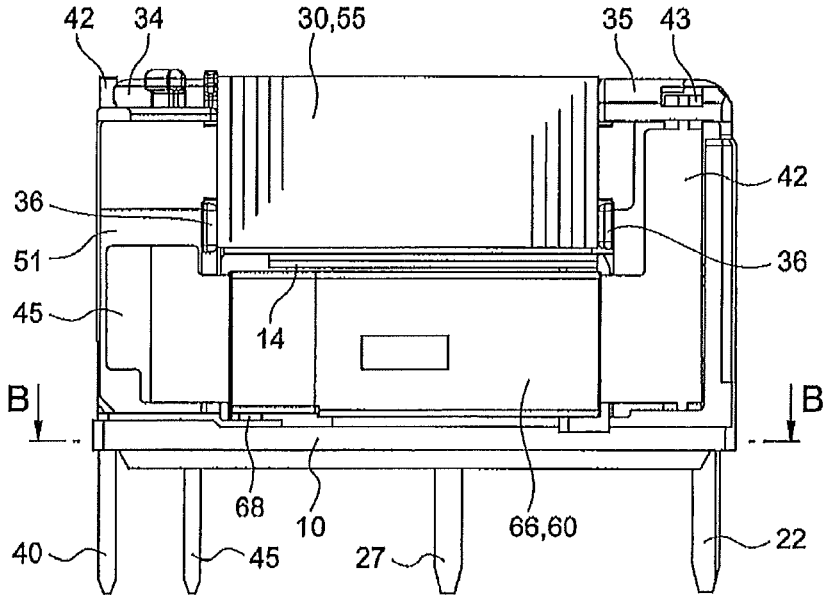
FIG. 10A is a front view of the electromagnetic relay shown in FIG. 2.
Figure 10B:
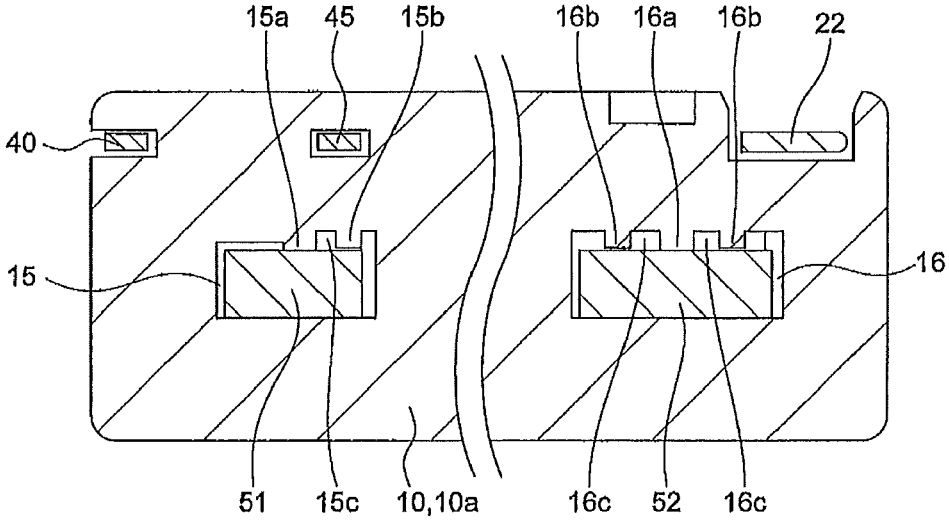
FIG. 10B is a partially enlarged cross-sectional view of FIG. 10A taken along a line B-B.

The base 10 has a substantially L-shaped flat partition wall 11 standing along a periphery of an upper surface of a substantially rectangular flat base part 10*a*, while the partition wall 11 has a bulge part 12 formed at a substantially middle portion thereof to secure space for a contact. Further, an insulating wall 14 laterally extends from an upper surface of the bulge part 12 between an electromagnetic block 30 and an armature 60 which are described later. Press-fit concave portions 15 and 16 for press fitting both ends of an after-mentioned iron core 50 are provided respectively at both sides of the bulge part 12 on the upper surface of the base part 10*a*. The press-fit concave portion 15 has a shaving receptacle 15*c* made by a separating rib 15*b* which is formed in a vertical direction at one side of a press-fit projection 15*a* as shown in FIG. 10B. Similarly, the press-fit concave portion 16 has shaving receptacles 16*c*, 16*c* made by separating ribs 16*b*, 16*b*, which are formed respectively in a vertical direction at both sides of a press-fit projection 16*a*. As such, the shaving receptacles 15*c* and 16*c* may hold the shavings which are produced when both end parts 51 and 52 of the iron core 50 are press-fitted into the press-fit concave portions 15 and 16. Since the shavings are held by the shaving receptacles 15*c* and 16*c* and not scattered and lost, bad electrical contact or failure of operation may be advantageously avoided. Further, a bearing part 17 for rotatably supporting a convex portion 64 of a rotating shaft of the armature 60 is provided closely adjacent to the press-fit concave portion 16 (FIG. 8C). Further, a positioning concave portion 19 is provided at the side of the press-fit concave portion 15 on the base part 10 to receive a stopper 68 of the armature 60 inserted therein as shown in FIG. 3A.

Figure 3B:
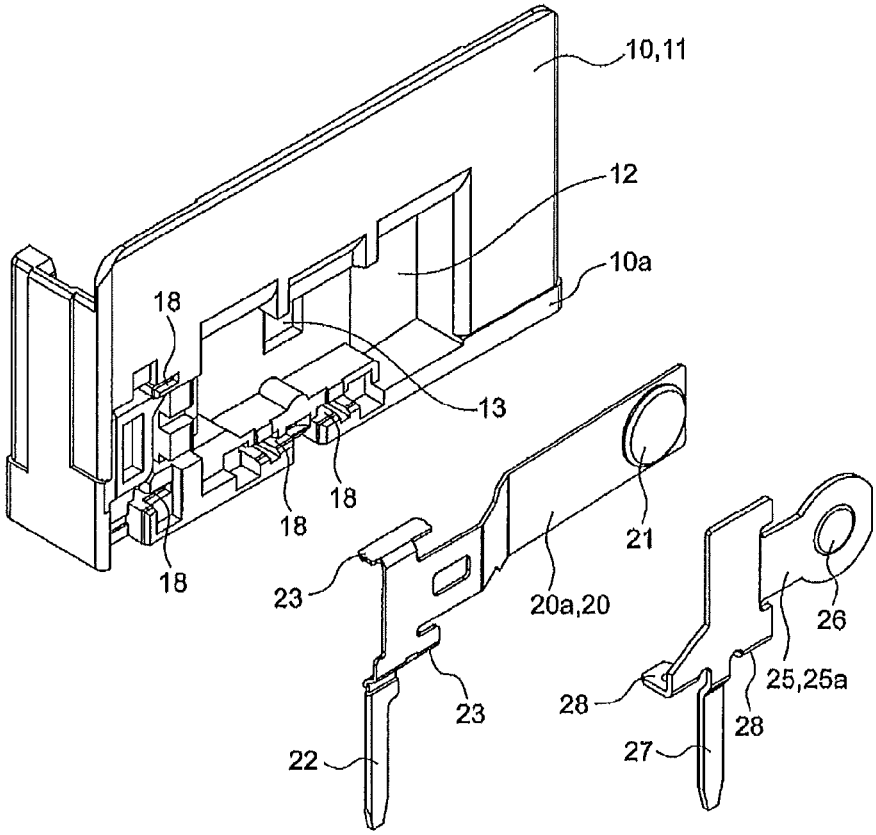
FIG. 3B is an exploded perspective view including the base shown in FIG. 2.

Further, a movable contact terminal 20 and a fixed contact terminal 25 are mounted on the base 10 as shown in FIG. 3B. The movable contact terminal 20 has a movable contact piece 20*a* and a movable contact 21 is provided on one end of the movable contact piece 20*a* while a terminal part 22 and a press-fit rib 23 are provided on the other end of the movable contact piece 20*a*. On the other hand, the fixed contact terminal 25 has a fixed contact piece 25*a* and a fixed contact 26 is provided on one end of the fixed contact piece 25*a* while a terminal part 27 and a press-fit rib 28 are provided on the other end of the fixed contact piece 25*a*. Thus, the press-fit rib 23 of the movable contact terminal 20 and the press-fit rib 28 of the fixed contact terminal 25 are press-fitted in press-fit receiving parts 18, 18 respectively such that the movable contact 21 faces the fixed contact 26, enabling the movable contact 21 to come into contact with or separate from the fixed contact 26 in the bulge part 12, while the movable contact piece 20*a* can be operated through an operational opening 13 of the bulge part 12 as shown in FIG. 3B.

Figure 4A:
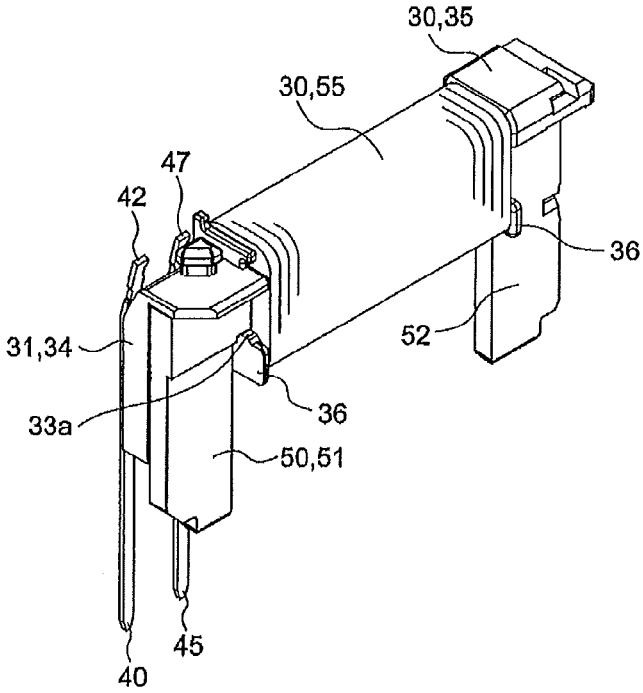
FIGS. 4A and 4B are perspective views showing an electromagnetic block shown in FIG. 2 viewed from different angles respectively.
Figure 6A:
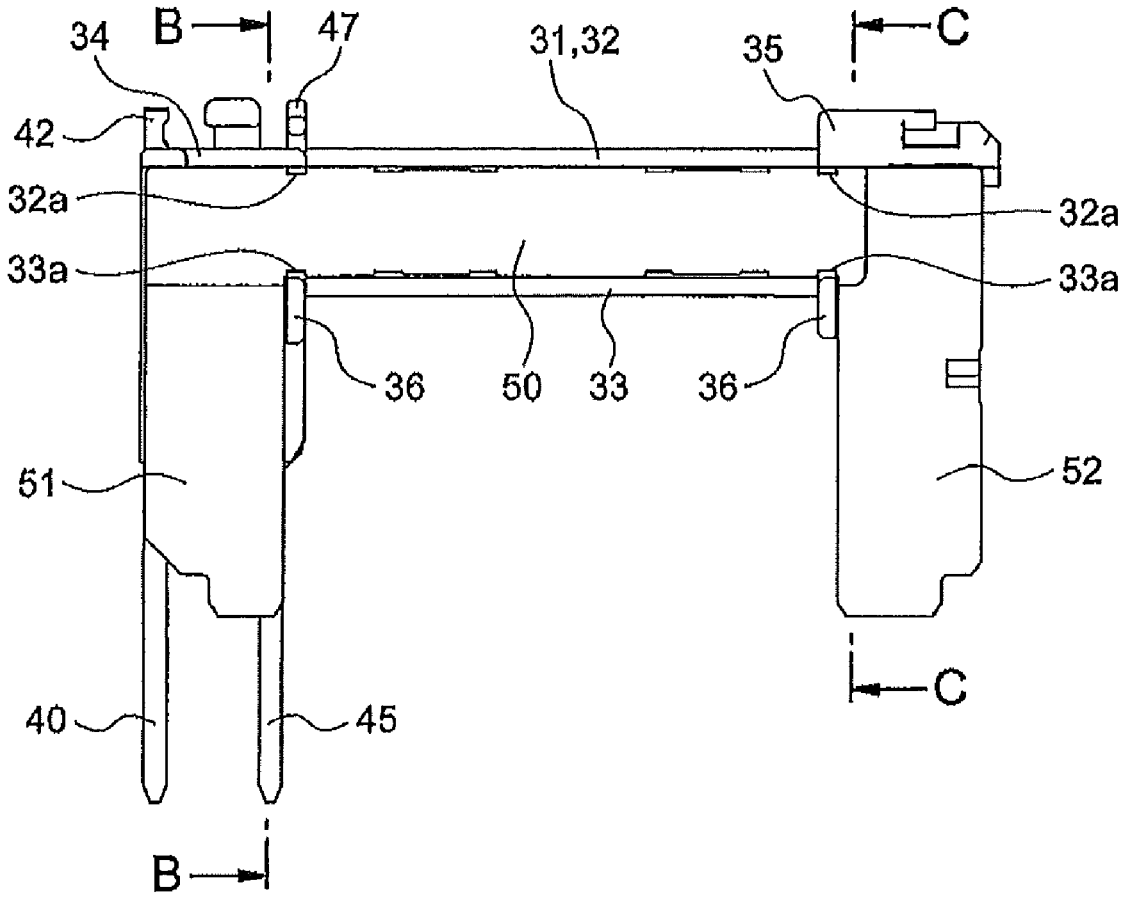
FIG. 6A is a front view of the electromagnetic block shown in FIGS. 4A and 4B without coil.
Figure 6B:
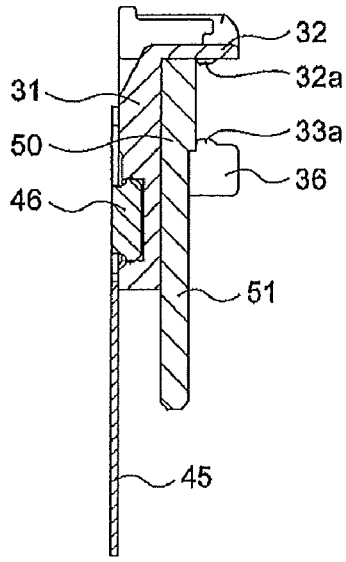
FIGS. 6B and 6C are cross-sectional views of FIG. 6A taken along lines B-B and C-C respectively.
Figure 6C:
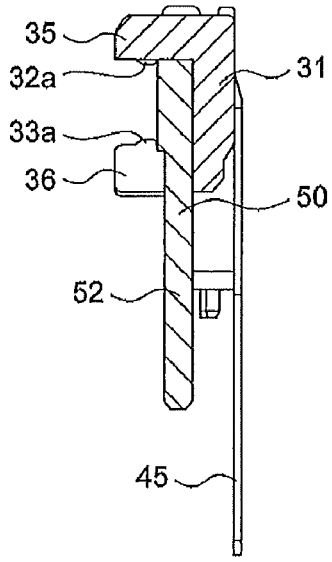

The electromagnetic block 30 is provided with a coil 55 wound around a spool 31 on which coil terminals 40 and 45 and a portal shaped iron core 50 are mounted as shown in FIGS. 4 and 6. At each end of spool 31, the ends of upper spool 32 and lower spool 33 are joined by joints 34 and 35 respectively, and projecting parts 36, 36 project laterally from both ends of the lower spool 33. The portal shaped iron core 50 is mounted between the upper spool 32 and the lower spool 33 by positioning projections 33*a*, 33*a*, while press-fit ribs 41 and 46 of a pair of coil terminals 40 and 45 are laterally press-fitted into the joint 34 respectively. As such, the portal shaped iron core 50 is mounted between the upper spool 32 and the lower spool 33 of the spool 31 by the projecting parts 36, 36, and lead wires of the coil 55 are twisted around fixing parts 42 and 47 of the coil terminals 40 and 45 and soldered respectively after the coil 55 is wound around the spool 31.

Figure 4B:
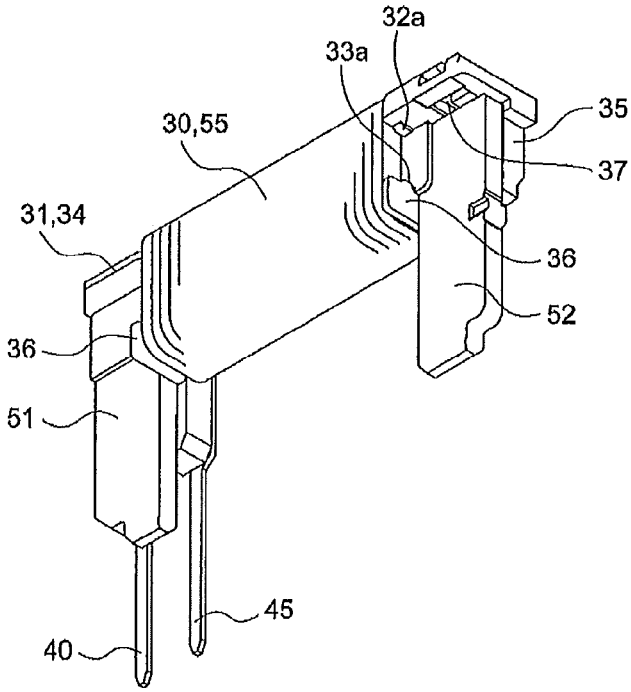
Figure 5:
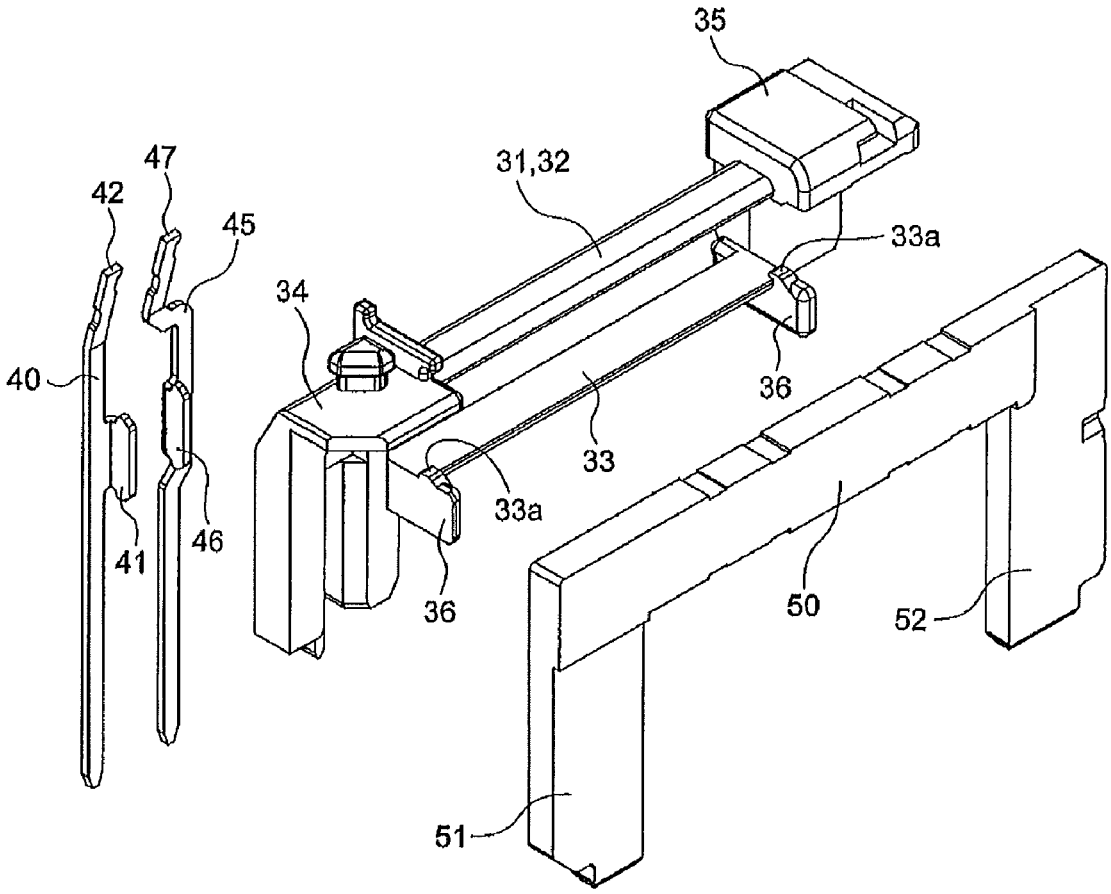
FIG. 5 is an exploded perspective view of a major part of the electromagnetic block shown in FIGS. 4A and 4B.
Figure 8A:
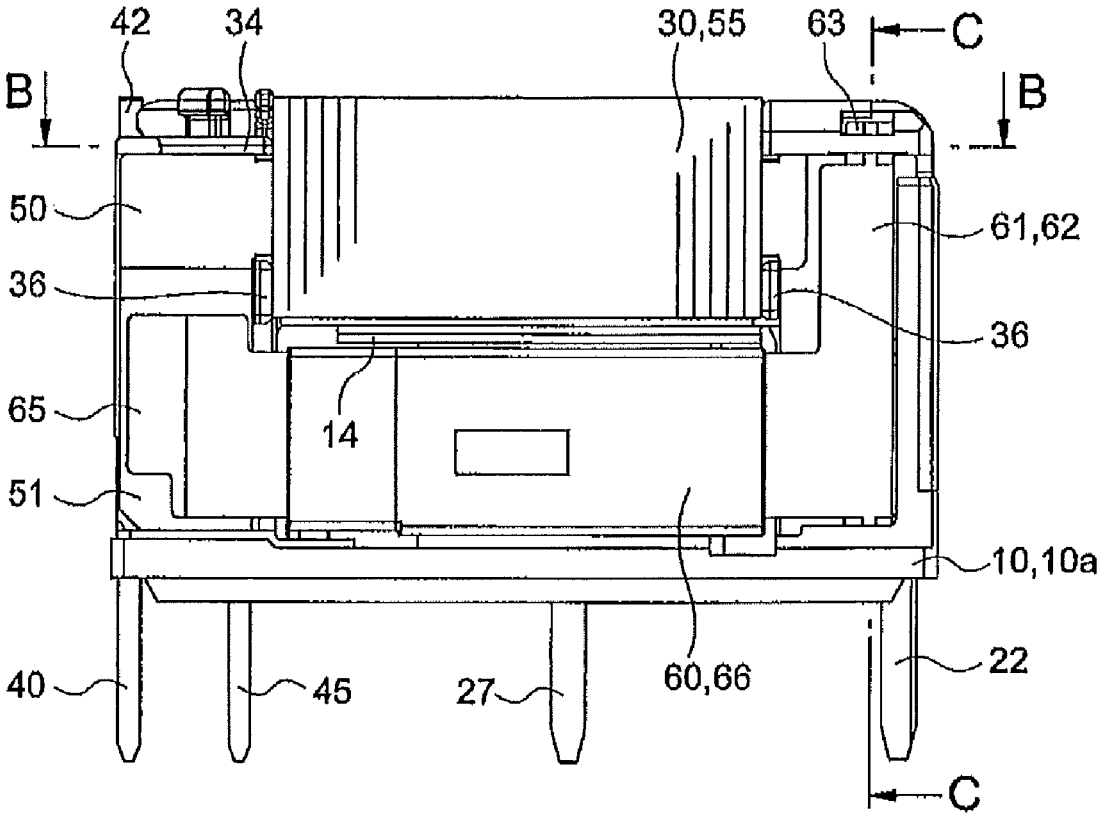
FIG. 8A is a front view of the electromagnetic relay shown in FIG. 2, and FIGS. 8B and 8C are cross-sectional views of FIG. 8A taken along lines B-B and C-C respectively.
Figure 8B:
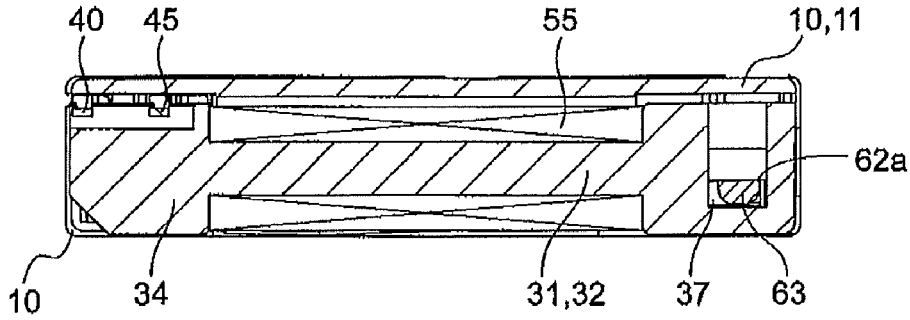
Figure 8C:
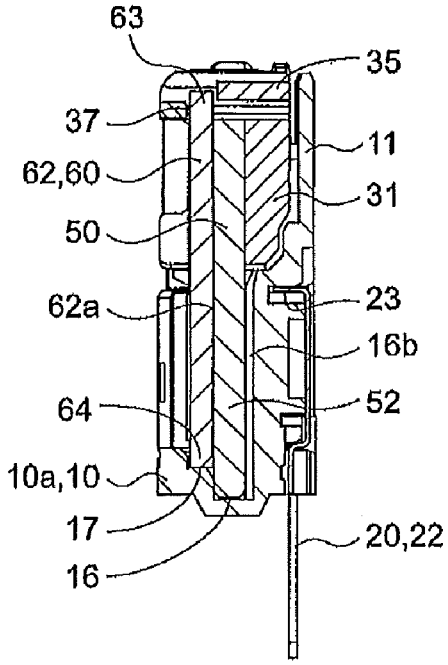

Further, a shaft hole 37 is formed in the joint 35 to rotatably support the armature 60 as shown in FIGS. 4B and 8B. In this embodiment, since the shaft hole 37 is formed in the joint 35 as a single part, accuracy of positioning is increased, thereby variation in operating characteristics can be advantageously suppressed.

Figure 7A:
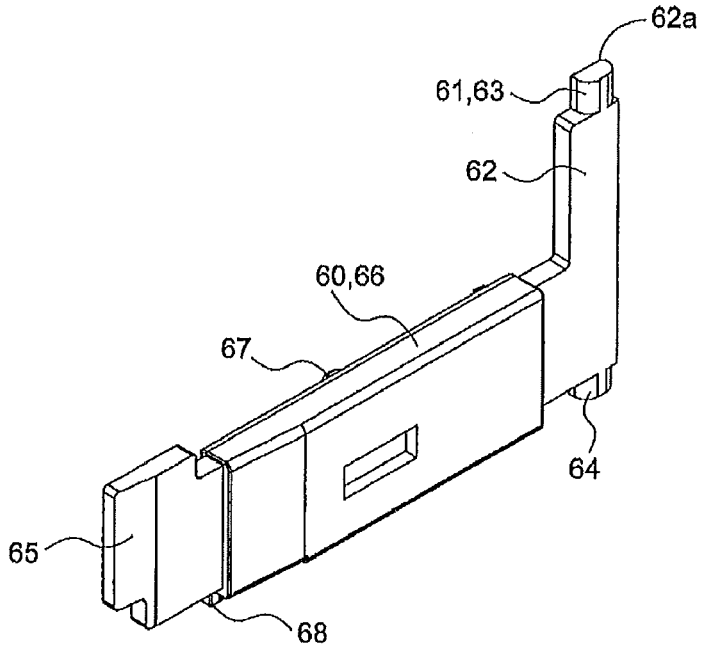
FIG. 7A is a perspective view of the armature shown in FIG. 2
Figure 7B:
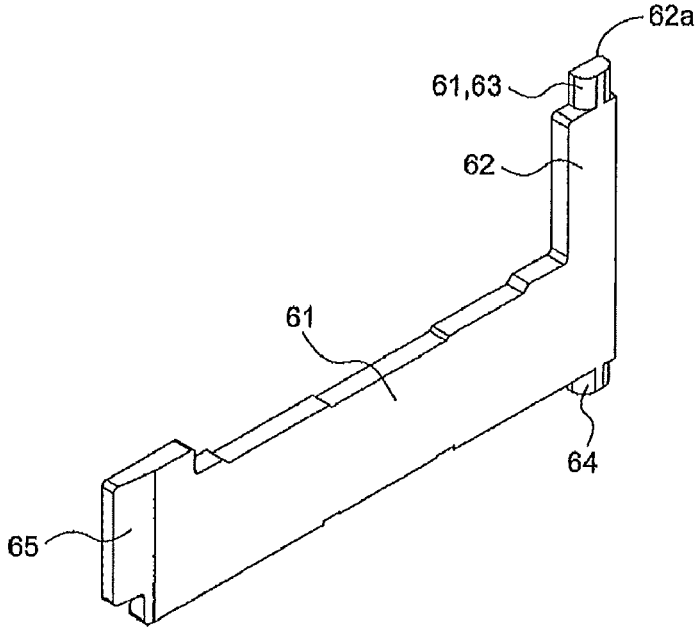
FIG. 7B is a perspective view of a movable iron piece.

The armature 60 includes a substantially L-shaped movable iron piece 61 having rotating shaft 62 formed vertically at one end and pulled part 65 at the other end as shown in FIGS. 7A and 7B. The movable iron piece includes an operational projection 67 projecting from the inner surface and a stopper 68 at the lower end formed through outsert molding of an insulating material 66. In addition, upper and lower ends of the rotating shaft 62 have rotating-shaft convex portions 63 and 64 projecting along the same shaft center respectively. The rotating shaft 62 has a flat surface in the side of the operational projection 67, and an edge of the flat surface becomes a rotational axis 62*a*, while outer surfaces of the rotating-shaft convex portions 63 and 64 are formed to be curved surfaces.

Figure 1:
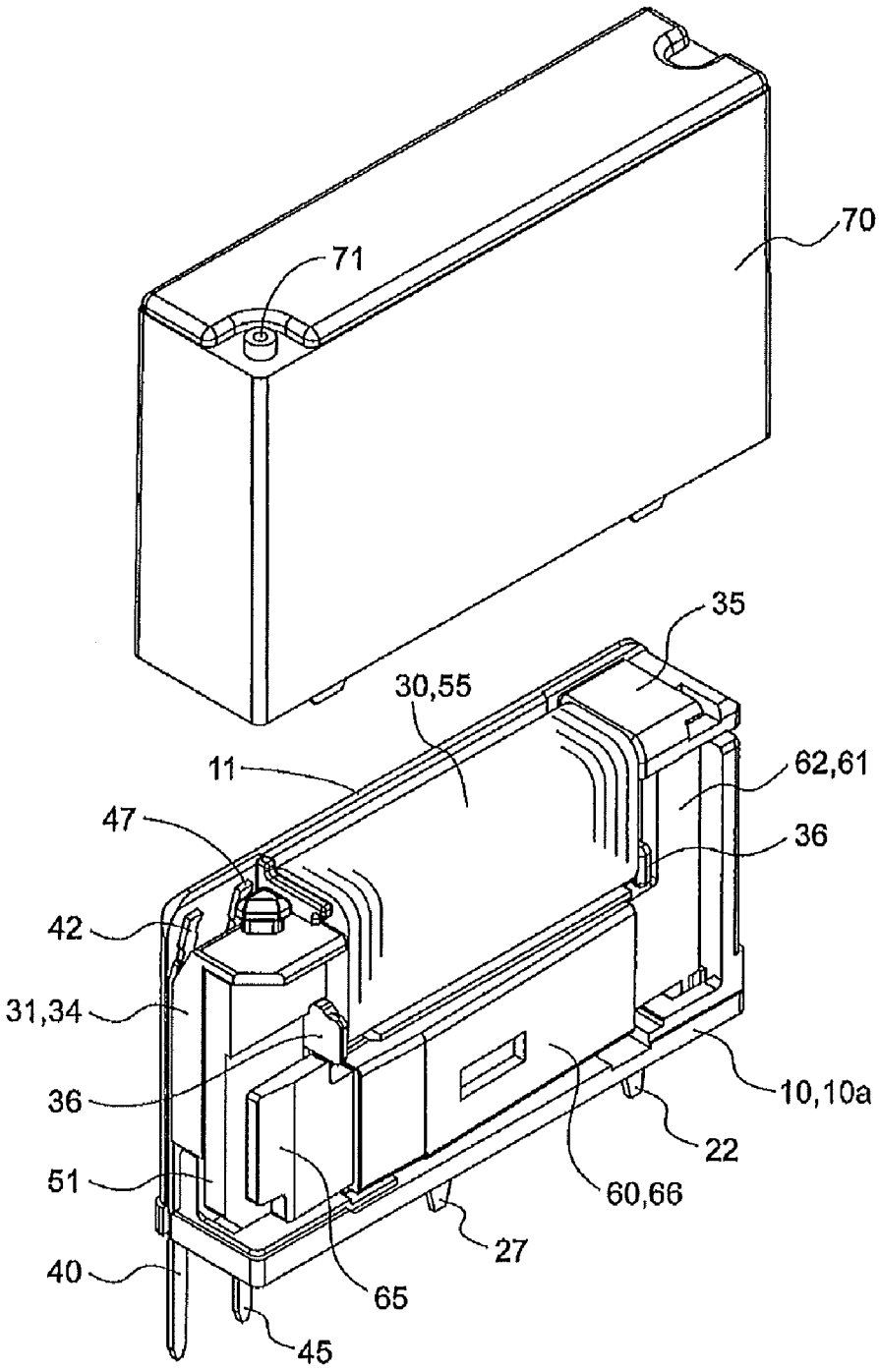
FIG. 1 is an exploded perspective view showing a first embodiment of an electromagnetic relay according to the present invention.

The case 70 is box-shaped and adapted to be engaged with the base 10 on which the electromagnetic block 30 and the armature 60 are mounted, the case 70 having a vent hole 71 at the corner of the upper surface as shown in FIG. 1.

Next, a method of assembling the electromagnetic relay including the above-mentioned parts is described.

Figure 2:
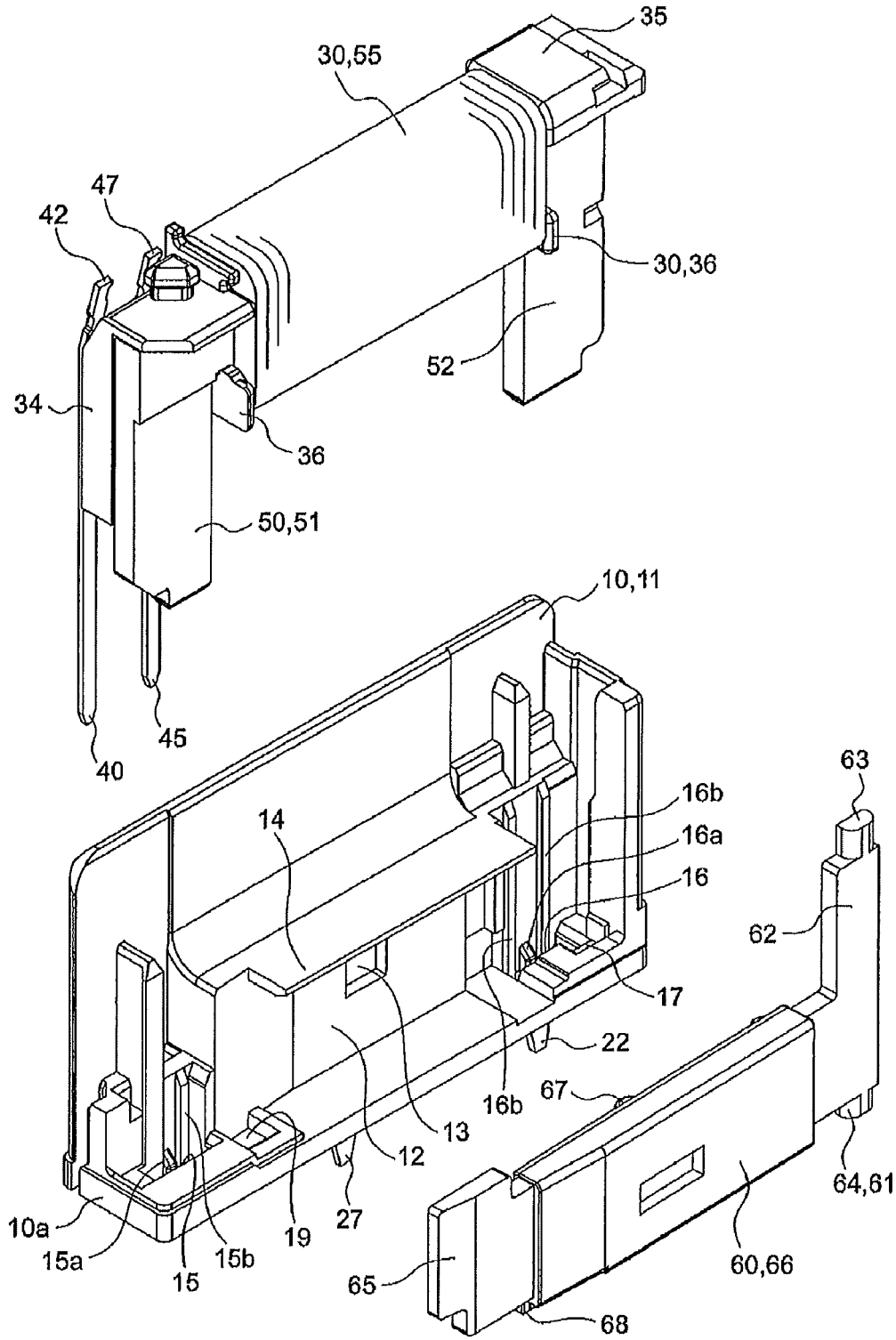
FIG. 2 is an exploded perspective view showing a major part of the electromagnetic relay shown in FIG. 1.

First, both ends 51 and 52 of the iron core 50 of the electromagnetic block 30 are press-fitted halfway into the concave portions 15 and 16 of the base 10 respectively and temporarily joined there as shown in FIG. 2. Since both ends 51 and 52 of the iron core 50 are pushed into the concave portions 15 and 16 with the lower end surfaces being pressed against press-fit projections 15*a* and 16*a* of the base 10, shavings are produced from the press-fit projections 15*a* and 16*a*. The shavings produced in this process (not shown) enter the shaving receptacles 15*c* and 16*c* and are held there (FIG. 10B).

Figure 11A:
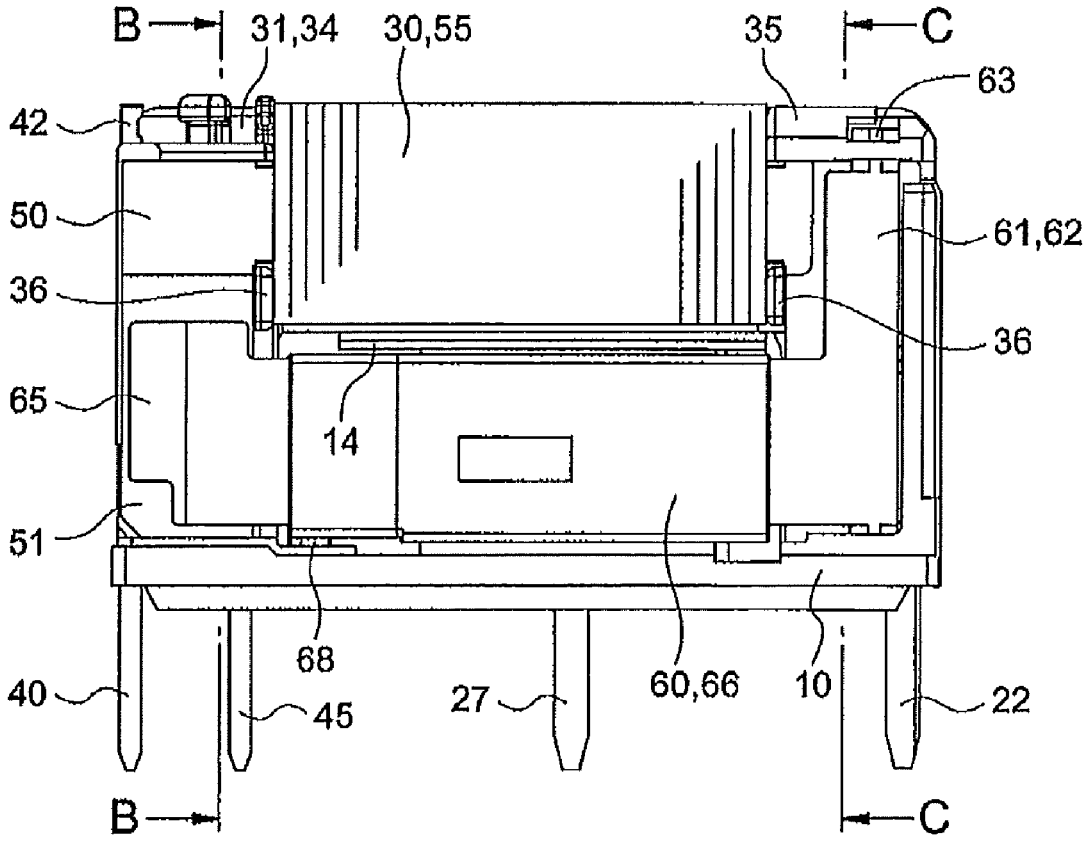
FIG. 11A is a front view of the electromagnetic relay shown in FIG. 2, and FIGS. 11B and 11C are enlarged cross-sectional views of FIG. 11A taken along lines B-B and C-C respectively.
Figure 11B:
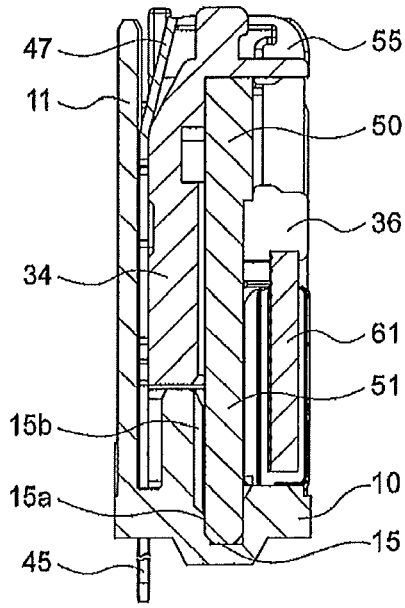
Figure 11C:
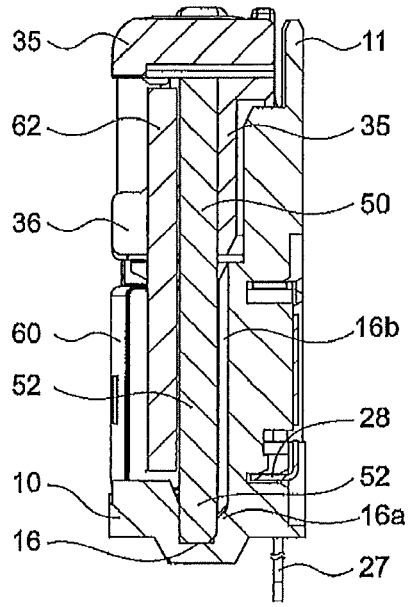

In particular, since the joints 34 and 35 of the spool 31 extend to the tops of the separating ribs 15*b* and 16*b* to serve as lids for the shaving receptacles 15*c* and 16*c* as shown in FIGS. 11B and 11C, the shaving receptacles 15*c* and 16*c* are separated substantially by 6 surfaces. Thus, the shavings are prevented from being scattered and lost, and bad electrical contact and failure of operation caused by such scattered and lost shavings may be advantageously avoided.

In FIG. 10B, although enlarged space is shown between the one end 51 of the iron core 50 and the concave portion 15 of the base 10, there is actually little space between both parts and shavings are likely to enter the shaving receptacle 15*c* as it has comparatively small friction when the shavings enter them. As such, the shavings are eventually held in the shaving receptacles 15*c* and 16*c*. The shaving receptacles 15*c* and 16*c* may be made at least one side of the press-fit projections 15*a* and 16*a* closer to the contacts 21 and 26.

Further, the separating ribs 15*b* and 16*b* and both ends 51 and 52 of the iron core 50 are configured to create as little space as possible between them so as not to contact each other within dimensional tolerances of each part, such that the shavings are difficult to get out of the shaving receptacles 15*c* and 16*c* once they fall therein.

Next, the rotating-shaft convex portion 64 of the armature 60 is inserted into the bearing part 17 of the base 10 from obliquely up above while the stopper 68 is inserted into the positioning concave portion 19 from obliquely above to be positioned in a vertical direction as shown in FIG. 2. Then, the other rotating-shaft convex portion 63 is inserted into and rotatably supported by the shaft hole 37 that is provided at the joint 35 of the spool 31, while the temporarily joined electromagnetic block 30 is pushed down to a predetermined position. As such, the rotating shaft 62 of the armature 60 is positioned with the rotational axis 62*a* located at an edge of the flat face having line contact to the iron core 50 as shown in FIGS. 8B and 8C. In this way, the rotating shaft 62 is positioned relative to the iron core 50 only through the shaft hole 37, which is formed on the spool 31 for the upper end and the bearing part 17 of the base 10 for the lower end. Thus, adverse effects on operating characteristics caused by variation in part dimensions can be advantageously minimized.

Then, the case 70 is engaged with the base 10 as shown in FIG. 1, a sealing agent is applied between the base 10 and the case 70, and the sealing agent is hardened by heating. Heated and swollen air inside the case 70 is discharged outside through the vent hole 71. The assembling operation is completed by heat-sealing the vent hole 71.

Figure 9A:
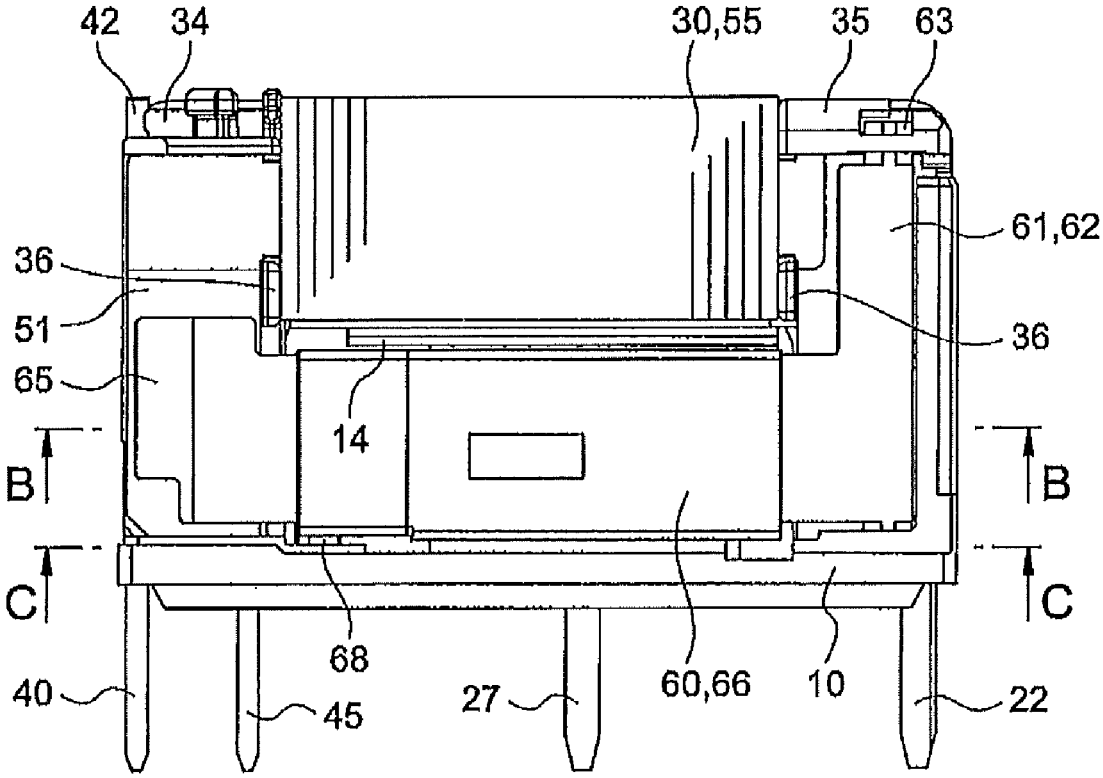
FIG. 9A is a front view of the electromagnetic relay shown in FIG. 2, and FIGS. 9B and 9C are cross-sectional views of FIG. 9A taken along lines B-B and C-C respectively.
Figure 9B:
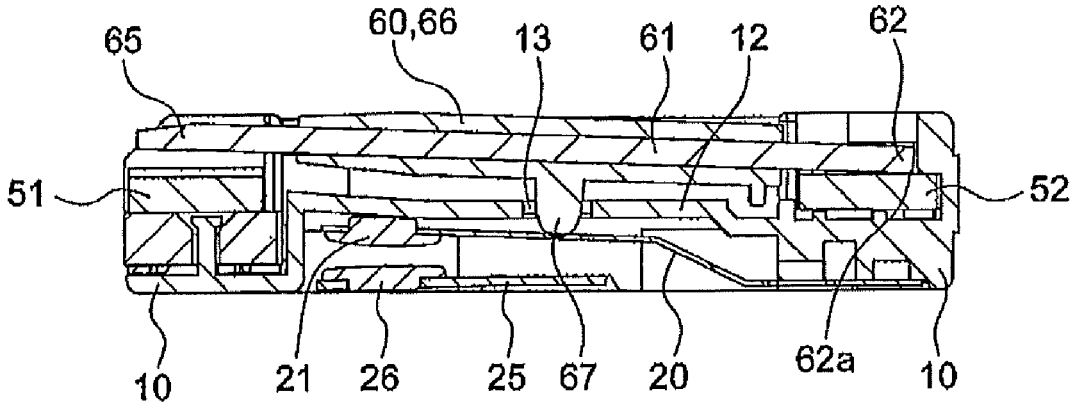

Operation of the electromagnetic relay is described with reference to FIG. 9. When a voltage is not applied to the coil 55, the operational projection 67 of the movable iron piece 61 is biased by a spring force of the movable contact piece 20*a* and the movable contact 21 is separated from the fixed contact 26. The stopper 68 of the armature 60 contacts with the inner surface of the positioning concave portion 19, thereby the pulled part 65 of the movable iron piece 61 is restrained in a position.

When a voltage is applied to the coil 55 through the coil terminals 40 and 45, a magnetic pole part 51 at one end of the iron core 50 pulls the pulled part 65 of the movable iron piece 61, and the movable iron piece 61 rotates around the rotational axis 62*a* of the rotating shaft 62 against the spring force of the movable contact piece 20*a*. As such, the operational projection 67 presses the movable contact piece 20*a* to rotate it, thereby the movable contact 21 comes into contact with the fixed contact 26, then the pulled part 65 of the movable iron piece 61 is pulled to the magnetic pole part 51 at one end of the iron core 50.

Further, when magnetization is terminated by releasing application of a voltage to the coil 55, the operational projection 67 is pushed back by the spring force of the movable contact piece 20*a*, thereby the armature is rotated in a direction opposite to the previous rotation and the movable contact 21 and the movable iron piece 61 return to their original positions. The outer surfaces of the rotating-shaft convex portions 63 and 64 opposite to the surface facing the iron core

Figure 9C:
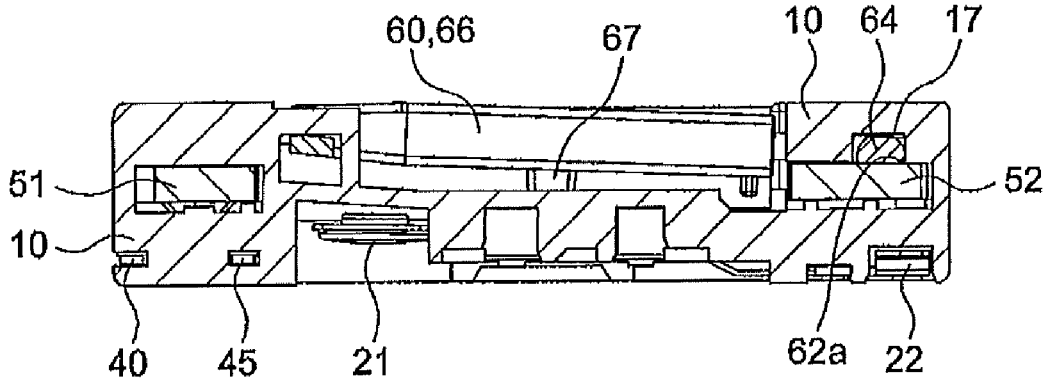

50 are formed to be curved surfaces as shown in FIGS. 8B and 9C. As such, the rotation of the rotating shaft convex portions 63 and 64 is not hindered by the shaft hole 37 or the bearing part 17.

Figure 12A:
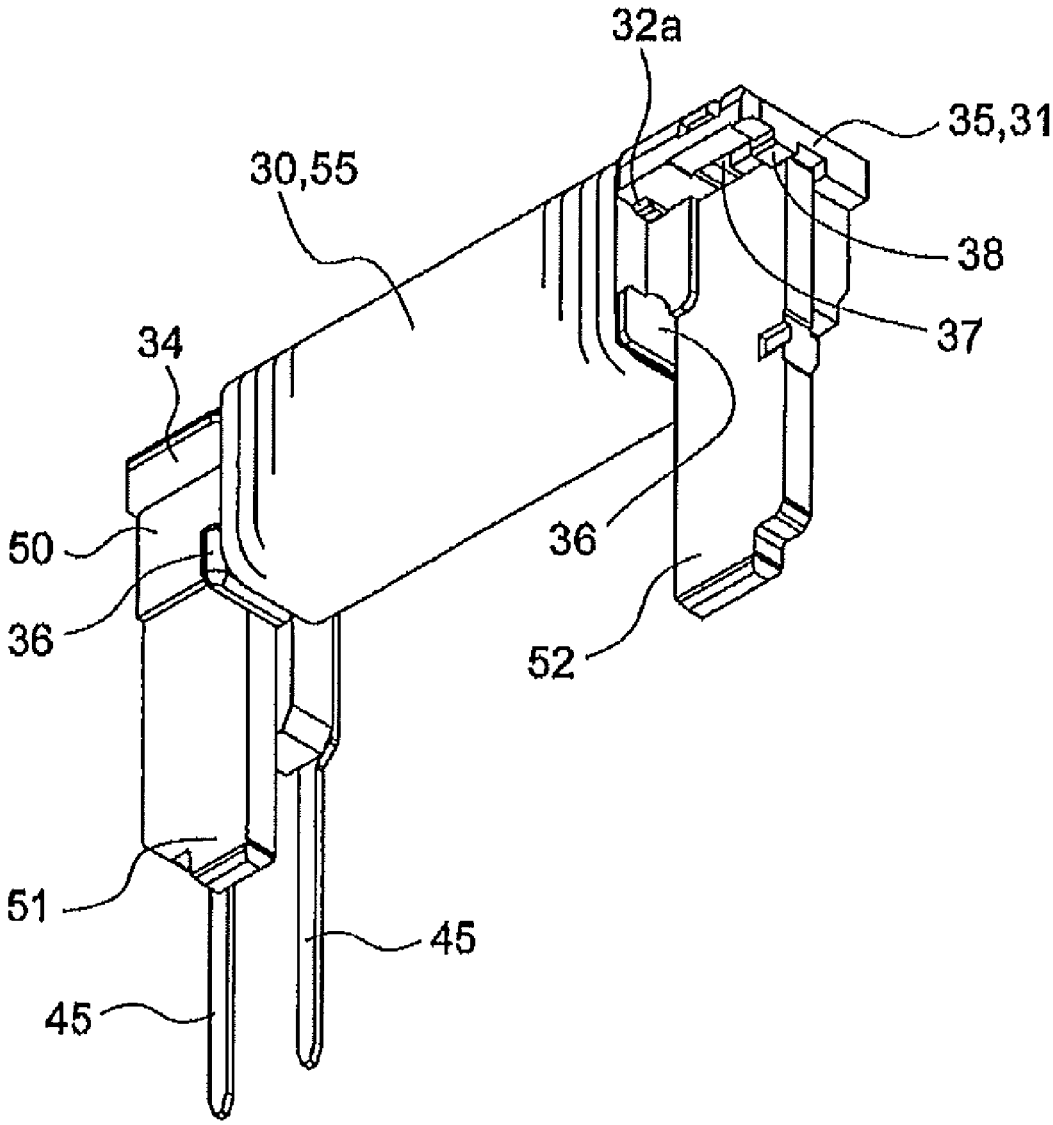
FIG. 12A is a perspective view of an electromagnetic block of an electromagnetic relay according to a second embodiment of the present invention.
Figure 12B:
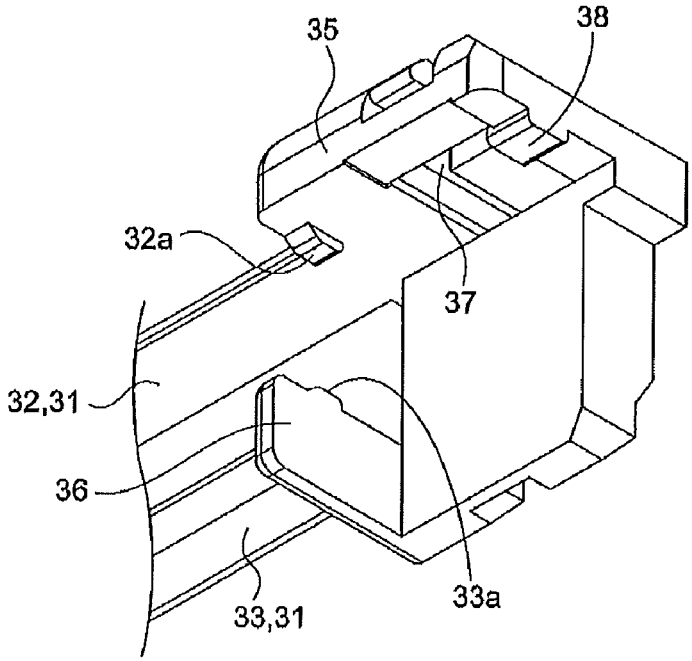
FIGS. 12B and 12C are a partially enlarged perspective view and a right side view of the electromagnetic block respectively.
Figure 12C:
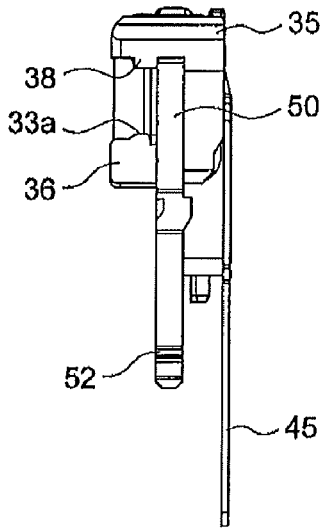

A second embodiment is substantially the same as the above-mentioned first embodiment except that a positioning projection 38 for positioning the iron core 50 is provided adjacent to the shaft hole 37 on the lower surface of the joint 35 of the spool 31 as shown in FIG. 12.

According to this embodiment, since positioning accuracy of the iron core 50 with respect to the spool 31 is improved, positioning accuracy between the iron core 50 and the armature 60 rotatably supported by the spool 31 is also improved, thus variations in operating characteristics may be suppressed.

According to this embodiment, assembling becomes easy while accuracy of positioning the iron core 50 with respect to the spool 31 is increased, thereby assembling accuracy is increased furthermore and variation in operating characteristics may be suppressed. In particular, when the case 70 is engaged with the base 10, a compressing force is applied to the joint 35 of the spool 31 to deflect the joint 35, thereby the iron core 50 adjacent to the shaft hole 37 may be relatively displaced. As such, the movable iron piece 61 having the rotating-shaft convex portions 63 inserted into the shaft hole 37 may be hindered to rotate. However, the relative displacement of the iron core 50 may be eliminated by positioning the iron core 50 through the positioning projection 38, and thus this embodiment has an advantage that the movable iron piece 61 may not be hindered to operate.

The electromagnetic relay according to the present invention may be applied not only to the electromagnetic relays with the above-mentioned structures, but also to other electromagnetic relays as well.

The specific embodiments described above are intended to be non-limiting examples, and the invention may be practiced otherwise than as specifically described herein without departing from the scope thereof.

The invention claimed is:

1. An electromagnetic relay comprising;

a movable iron piece, a base, an electromagnetic block mounted on the base, the electromagnetic block provided with a spool, a pair of upper and lower rotating shaft convex portions provided at one end of the movable iron piece along a same shaft center, the pair of convex portions being configured to be rotatably supported by the base and the spool respectively, wherein a movable contact piece is configured to be driven by the movable iron piece rotated by magnetization or demagnetization of the electromagnetic block to open or close a contact, wherein one end of the spool has a shaft hole in which the upper rotating shaft convex portion is configured to be inserted, the shaft hole does not penetrate through the spool, and the circumference of the shaft hole extends continuously.

2. The electromagnetic relay according to claim 1, wherein a positioning projection configured to position the iron core with respect to the spool is provided adjacent to the shaft hole configured to rotatably support the movable iron piece at one end of the spool.

3. The electromagnetic relay according to claim 1, wherein outer surfaces of the rotating-shaft convex portions opposite to a surface facing the iron core are formed to be curved surfaces.

* * * * *